US011920873B2

(12) United States Patent
Steinbauer et al.

(10) Patent No.: US 11,920,873 B2
(45) Date of Patent: Mar. 5, 2024

(54) WOUND HEAT EXCHANGER, METHOD FOR PRODUCING A WOUND HEAT EXCHANGER AND METHOD FOR EXCHANGING HEAT BETWEEN A FIRST FLUID AND A SECOND FLUID

(71) Applicant: Linde GmbH, Pullach (DE)

(72) Inventors: Manfred Steinbauer, Raisting (DE); Manfred Schönberger, Tacherting (DE); Christoph Seeholzer, Trostberg (DE); Florian Deichsel, Munich (DE); Markus Romstätter, Palling (DE)

(73) Assignee: Linde GmbH, Pullach (DE)

( * ) Notice: Subject to any disclaimer, the term of this patent is extended or adjusted under 35 U.S.C. 154(b) by 348 days.

(21) Appl. No.: 17/280,237

(22) PCT Filed: Sep. 27, 2019

(86) PCT No.: PCT/EP2019/025321

§ 371 (c)(1),
(2) Date: Mar. 26, 2021

(87) PCT Pub. No.: WO2020/074117

PCT Pub. Date: Apr. 16, 2020

(65) Prior Publication Data

US 2022/0034595 A1 Feb. 3, 2022

(30) Foreign Application Priority Data

Oct. 9, 2018 (EP) ..... 18020488

(51) Int. Cl.
*F28D 7/02* (2006.01)
*F28F 9/013* (2006.01)

(52) U.S. Cl.
CPC ..... *F28D 7/024* (2013.01); *F28F 9/0132* (2013.01); *F28F 2210/10* (2013.01)

(58) Field of Classification Search
CPC .. F28D 7/02; F28D 7/024; F28D 7/028; F28F 9/013; F28F 9/0132
See application file for complete search history.

(56) References Cited

U.S. PATENT DOCUMENTS 4,167,211 A * 9/1979 Haller ..... F28F 9/0132 165/172
4,556,104 A 12/1985 Engelhardt
2013/0139541 A1* 6/2013 Seybold ..... F25B 40/00 165/154

FOREIGN PATENT DOCUMENTS

DE 19902743 A1 7/1999
EP 2505932 A1 10/2012
(Continued)

*Primary Examiner* — Eric S Ruppert
(74) *Attorney, Agent, or Firm* — Millen, White, Zelano & Branigan, P.C.; Brion P. Heaney

(57) ABSTRACT

The invention relates to a wound heat exchanger having a core tube extending along a longitudinal axis in an axial direction and having a tube bundle, which has a plurality of tubes for conducting a first fluid, wherein the tubes are wound about the core tube in a plurality of windings, the tubes being arranged in a radial direction perpendicular to the axial direction in a plurality of tube layers, adjacent windings of at least one tube layer having different axial distances in the axial direction and/or tube layers adjacent in the radial direction having different radial distances from each other in a cross-sectional plane perpendicular to the longitudinal axis. The invention further relates to a method for producing a wound heat exchanger and to a method for transferring heat between a first fluid and a second fluid by means of the heat exchanger.

14 Claims, 4 Drawing Sheets

(56) References Cited

FOREIGN PATENT DOCUMENTS

Figure 1:
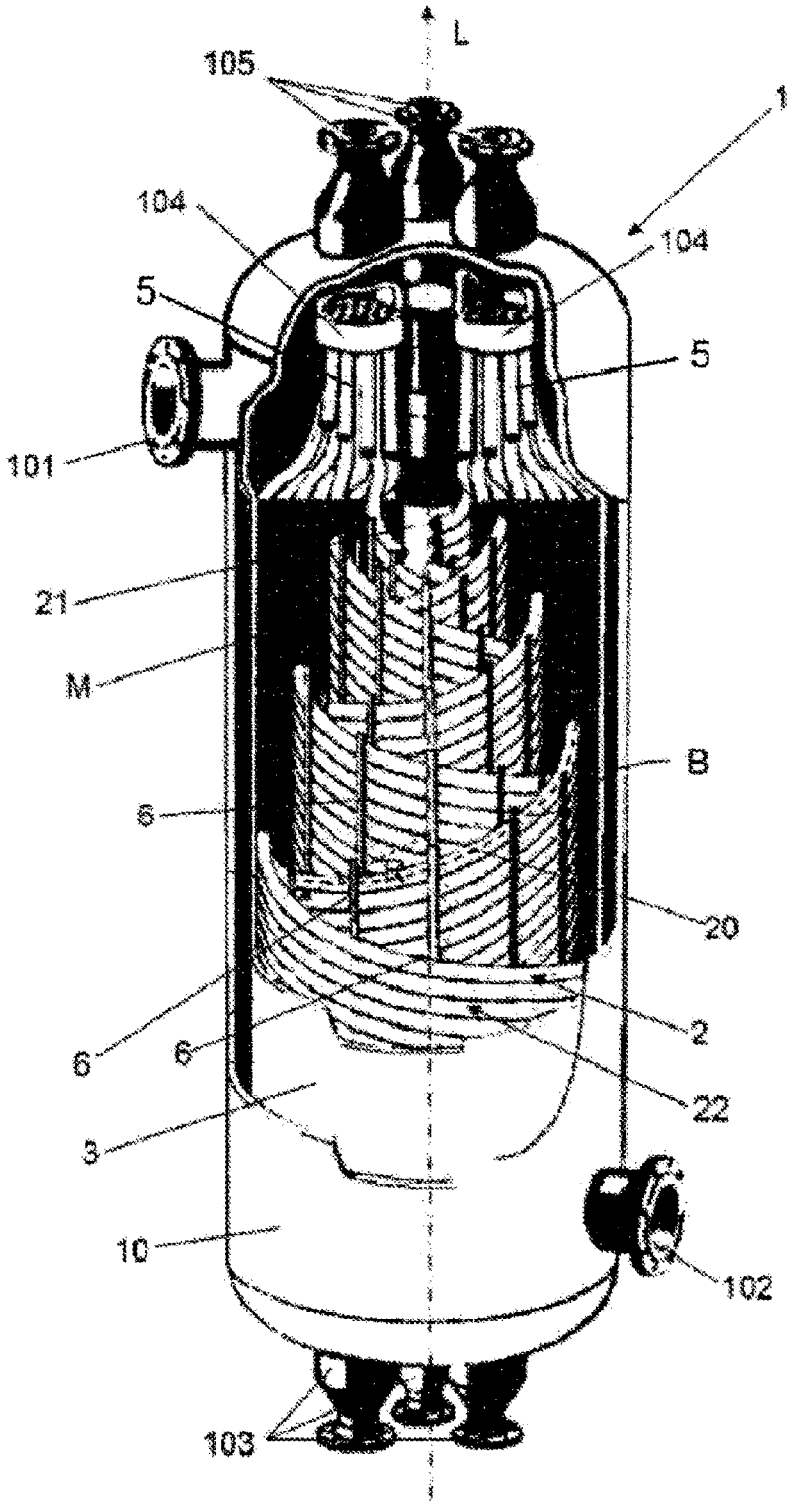

| | | | | |
|---|---|---|---|---|
| EP | 3101340 | A1 | | 12/2016 |
| GB | 912710 | A | * | 12/1962 |
| SU | 1134877 | A | * | 1/1985 |
| WO | 00/25074 | A1 | | 5/2000 |

* cited by examiner

WOUND HEAT EXCHANGER, METHOD FOR PRODUCING A WOUND HEAT EXCHANGER AND METHOD FOR EXCHANGING HEAT BETWEEN A FIRST FLUID AND A SECOND FLUID

The invention relates to a wound heat exchanger, a method for producing a wound heat exchanger, and a method for exchanging heat between a first fluid and a second fluid by means of the wound heat exchanger.

Such wound heat exchangers have a pressure-retaining shell, which surrounds a shell space and extends along a longitudinal axis, and a core tube which runs within the shell and extends in an axial direction along the longitudinal axis, which—relative to a heat exchanger arranged as intended—preferably runs along the vertical during the intended operation of the heat exchanger.

The heat exchanger further has a tube bundle which is arranged in the shell space and has a plurality of tubes, wherein the tubes are wound helically at least in sections in a plurality of windings around the core tube. The winding around the core tube takes place in a plurality of tube layers arranged one above the other. The tube layers may be formed from one tube or a plurality of tubes (which are wound around the core tube in the form of a multiple helix), wherein the tubes of a tube layer each form a plurality of windings.

The core tube in particular supports the load of the tube bundle.

Between the tube layers, so-called webs can be provided as spacers in the radial direction.

The tubes are configured to conduct a first fluid, and the shell space is configured to receive a second fluid such that the first fluid flowing through the tubes can exchange heat with the second fluid during operation of the heat exchanger.

Wound heat exchangers are designed and manufactured according to the prior art with a uniform arrangement or spacing of the windings of a respective tube layer in the axial direction and uniform distances of the wound tube layers from the longitudinal axis of the core tube in a radial direction perpendicular to the axial direction. That is to say, for the tube layers of the tube bundle, there is a predefined radial division with constant radial distances of a respective tube layer from the longitudinal axis (or from the core tube) between adjacent tube layers, and a predefined axial division of the windings of the respective tube layer with constant distances between adjacent windings, wherein the distances can deviate slightly only on account of manufacturing tolerances of the manufactured heat exchanger.

Given the uniform distribution of the winding, the heating surface and thus the tube bundle weight are distributed uniformly over the tube bundle length. Depending on the shell-side flow regime of the second fluid provided in the shell space, the requirements for the heating output at different positions of the tube bundle are different, however.

Particularly in the case of very large wound heat exchangers, structural mechanical problems on the end of the tube bundle also result from the load during the winding process.

It is therefore an object of the present invention to provide a wound heat exchanger as well as a manufacturing method and a method to exchange heat that are improved in light of the described disadvantages of the prior art.

This object is achieved by the subject matter of independent claims 1, 10 and 11. Advantageous embodiments are specified in dependent claims 2 to 9 as well as 12 and 13 and are described below.

A first aspect of the invention relates to a wound heat exchanger having a core tube extending along a longitudinal axis in an axial direction and having a tube bundle, which has a plurality of tubes for conducting a first fluid, wherein the tubes are wound, especially helically, about the core tube in a plurality of windings, and wherein the tubes are arranged in a radial direction perpendicular to the axial direction in a plurality of tube layers, wherein adjacent windings of at least one tube layer has different axial distances in the axial direction, wherein the axial distances of the adjacent windings of said tube layer grow monotonically in the axial direction, at least in a section of the tube bundle. Alternatively or additionally, it is provided that tube layers adjacent to each other in the radial direction have different radial distances from one another in a cross-sectional plane perpendicular to the longitudinal axis, wherein the radial distances of the adjacent tube layers grow monotonically in the radial direction (for example from inside to outside), at least in a section of the tube bundle.

In this case, the axial distances run in the axial direction, and the radial distances run in the radial direction.

The longitudinal axis is in particular a central axis of the core tube, which means that the wall of the core tube is arranged concentrically about the longitudinal axis.

"Two windings adjacent to each other in the axial direction" means windings of a tube layer between which no further winding is located in the axial direction. There is no further tube layer between tube layers adjacent to each other in the radial direction.

In particular by 3D CAD modeling of complete wound heat exchangers, it is possible to modify the radial and axial division of the tube arrangement as desired. In this case, a combination consisting of a different radial division and a different axial division is also possible.

By means of the different axial or radial distances, the "tube packing density" can be reduced (that is to say, greater axial or radial distances are provided) for example in regions of the tube bundle having less influence from the turbulence/pressure loss of the first or second fluid on the heat transfer between the first and the second fluid, and can be made denser (i.e., with smaller axial or radial distances) in regions of the tube bundle in which there is a greater influence from turbulence/pressure loss of the first or second fluid on the heat transfer. In other words, by selectively installing denser and looser "winding regions", the pressure loss can be optimized depending on the requirements of the flow regime.

Furthermore, by means of the arrangement according to the invention of the tube bundle, it is possible to reduce the weight of the tube bundle with optimized pressure loss.

Furthermore, a mechanically improved bundle structure can be achieved through an overall lower weight per bundle length (or total length of all tubes of the tube bundle).

Moreover, in certain applications, a greater axial or radial distance between the tubes may cause intentional icing of certain regions of the tube bundle, since a thicker layer of ice may collect between the adjacent tubes due to the greater distance. Such local icing of certain regions is particularly advantageous when the tube bundle is used in a water bath evaporator, wherein a refrigerant (as a first fluid) is conducted in the tubes and exchanges heat with hot water (second fluid) of about 60° C. provided in the shell space. Freezing reduces the driving temperature difference for the evaporating refrigerant to such an extent that the Leidenfrost effect (acting as an additional thermal insulation) during evaporation is avoided. In this way, the heat transfer between the refrigerant and the water can be improved by the intentional freezing.

As already explained, the axial distances of the adjacent windings of said tube layer can grow monotonically in the axial direction, at least in a section of the tube bundle.

This means that the axial distances grow monotonically in sections or over the entire tube bundle.

Accordingly, in said section or over the entire tube bundle, the axial distance between a first winding and an adjacent second winding is greater than the axial distance between the second winding and a third winding adjacent to the second winding, for each adjacent pair of windings.

As has also already been stated, the radial distances of the adjacent tube layers can grow monotonically in the radial direction at least in a section of the tube bundle.

Accordingly, in said section or over the entire tube bundle, the radial distance between a first tube layer and an adjacent second tube layer is greater than the radial distance between the second tube layer and a third tube layer adjacent to the second tube layer, for each adjacent pair of tube layers.

According to another embodiment, the windings of at least one tube layer have different radial distances from the longitudinal axis or the core tube in the radial direction.

That is, the respective tube layer at least in sections does not run parallel to the longitudinal axis (in the axial direction) but in particular runs obliquely to the longitudinal axis. In certain cross-sectional planes of the tube bundle perpendicular to the longitudinal axis, this leads to different radial distances between adjacent tube layers. Alternatively to the embodiment just described, the different radial distances between the adjacent tube layers in a cross-sectional plane can also occur because tube layers running parallel to the longitudinal axis (in the axial direction) are spaced differently in the radial direction.

According to another embodiment, the radial distances of the windings of said tube layer from the longitudinal axis grow monotonically in the axial direction, at least in a section of the tube bundle.

The axial distances can thus grow monotonically in sections or over the entire tube bundle.

Accordingly, the radial distance of a first winding from the longitudinal axis is greater in said section or over the entire tube bundle than the radial distance from the longitudinal axis of a second winding adjacent to the first winding, and the radial distance of the second winding from the longitudinal axis is greater than the radial distance from the longitudinal axis of a third winding adjacent to the second winding.

According to a further embodiment, the tube bundle has a first section and a second section adjacent to the first section in the axial direction, wherein the adjacent windings of said tube layer in the first section have an axial distance which differs from an axial distance of the adjacent windings of said tube layer in the second section.

Between adjacent sections, no further section is provided in the axial direction.

According to a further embodiment, said tube layer has in the first section a first number of windings, a first height extending in the axial direction and a first packing density, wherein the first packing density is equal to the quotient of the first number and the first height, and wherein said tube layer has in the second section a second number of windings, a second height extending in the axial direction and a second packing density, wherein the second packing density is equal to the quotient of the second number and the second height, and wherein the first packing density differs from the second packing density.

According to a further embodiment, the first section is formed by a central section of the tube bundle, wherein the second section is formed by an end section of the tube bundle adjacent to the central section in the axial direction.

According to another embodiment, the end section has a lower packing density than the central section.

A so-called braid, for example, comprising the tubes of the tube bundle can connect to the end section of the tube bundle in the axial direction. In the braid, the layout of the tubes deviates from the helical route around the core tube, wherein the tubes of the tube bundle are guided in the braid to at least one tube bottom.

In particular, the tube bundle has a first end section and a second end section, wherein the central section is disposed in the axial direction between the first and second end sections.

Particularly in the case of very large wound heat exchangers, structural mechanical problems at the end of the tube bundle result from the load during the winding process. These problems can be solved by different radial and/or axial distances in such an end section.

According to a further embodiment, the tube bundle has an inner region and an outer region which surrounds the inner region in a cross-sectional plane perpendicular to the longitudinal axis, wherein the tube layers of the inner region adjacent to one another in the radial direction have radial distances from one another in the cross-sectional plane that differ from the radial distances in the cross-sectional plane between the tube layers of the outer region adjacent to one another in the radial direction.

In particular, the inner region and the outer region are arranged concentrically around the core tube, and the outer region is arranged concentrically around the inner region.

According to a further embodiment, the heat exchanger has a plurality of webs extending in the axial direction, wherein the webs each form a distance in the radial direction between two respective adjacent tube layers, and wherein the webs have different thicknesses in the radial direction.

The different radial distances can be realized in a structurally simple manner by means of the webs of different thickness.

Apart from the webs which are arranged between adjacent tube layers, webs between an innermost tube layer of the tube bundle and the core tube may also be provided.

According to another embodiment, the thickness of at least one of the webs varies along the axial direction.

The webs are in particular each arranged between two tube layers adjacent to one another in the radial direction, the windings of which have different radial distances from the longitudinal axis.

The web has a different thickness in particular perpendicular to its direction of longitudinal extension. In the intended use, the web is arranged on the tube bundle in such a way that said direction of longitudinal extension of the web runs parallel to the axial direction. The web contacts in particular the tube layers adjacent to one another in the radial direction. Different radial distances between the adjacent tube layers can accordingly be formed by the different thickness of the web.

A second aspect of the invention relates to a method for producing a wound heat exchanger, in particular according to the first aspect of the invention, wherein the tubes are wound around the core tube in such a way that adjacent windings of at least one tube layer have different axial distances in the axial direction, and/or tube layers adjacent to one another in the radial direction have different radial distances from one another in a cross-sectional plane perpendicular to the longitudinal axis.

According to a further embodiment, the tubes are wound around the core tube in such a way that the windings of at least one tube layer have different radial distances from the longitudinal axis in the radial direction.

According to a further embodiment, the route of the tubes of the tube bundle is calculated automatically, wherein the tubes are mounted according to the calculated route.

A third aspect of the invention relates to a method for exchanging heat between a first fluid and a second fluid by means of a wound heat exchanger according to the first aspect of the invention, wherein the first fluid flows through the tubes of the tube bundle, and wherein the second fluid is provided in a shell space in which the tube bundle of the heat exchanger is arranged so that heat is exchanged between the first fluid and the second fluid.

According to one embodiment of the method for exchanging heat, the adjacent windings of at least one tube layer in a first section of the tube bundle, in which turbulence or a pressure loss of the first fluid flowing through the tubes or of the second fluid provided in the shell space influences the heat exchange between the first fluid and the second fluid, have an axial distance that differs from an axial distance of the adjacent windings of the respective tube layer in a second section of the tube bundle adjacent to the first section in the axial direction, wherein in the second section, the turbulence or pressure loss of the first fluid or second fluid causes no significant influence or a reduced influence on the heat exchange between the first fluid and the second fluid.

According to a further embodiment, the axial distance of the adjacent windings of said tube layer in the first section of the tube bundle is smaller than the axial distance of the adjacent windings of said tube layer in the second section of the tube bundle.

As a result, for example, the heat exchange between the first and the second fluid influenced by the turbulence or the pressure loss can advantageously be optimized by a more constricted tube layout.

According to a further embodiment, the windings of at least one tube layer in a first section of the tube bundle, in which turbulence or a pressure loss of the first fluid flowing through the tubes or of the second fluid provided in the shell space influences the heat exchange between the first fluid and the second fluid, have a radial distance from the longitudinal axis that differs from a radial distance of the windings of the respective tube layer from the longitudinal axis in a second section of the tube bundle adjacent to the first section in the axial direction, wherein in the second section, the turbulence or pressure loss of the first fluid or second fluid causes no significant influence or a reduced influence on the heat exchange between the first fluid and the second fluid.

According to another embodiment, the radial distance of the windings of said tube layer from the longitudinal axis in the first section of the tube bundle is smaller than the radial distance of the windings of said tube layer from the longitudinal axis in the second section of the tube bundle.

As a result, for example, the heat exchange between the first and the second fluid influenced by the turbulence or the pressure loss can advantageously be optimized by a more constricted tube layout.

A fourth aspect of the present invention relates to a wound heat exchanger having a core tube extending along a longitudinal axis in an axial direction and having a tube bundle which has a plurality of tubes for conducting a first fluid, wherein the tubes are wound about the core tube in a plurality of windings, and wherein the tubes are arranged in a radial direction perpendicular to the axial direction in a plurality of tube layers, wherein adjacent windings of at least one tube layer have different axial distances in the axial direction, and/or tube layers adjacent in the radial direction have different radial distances from each other in a cross-sectional plane perpendicular to the longitudinal axis.

This fourth aspect may be further specified by one or more of the features described herein, particularly by incorporating one or more of the subjects of claims 2 to 9.

Further details and advantages of the invention are to be explained by the following description of figures of exemplary embodiments with reference to the figures.

Figure 2:
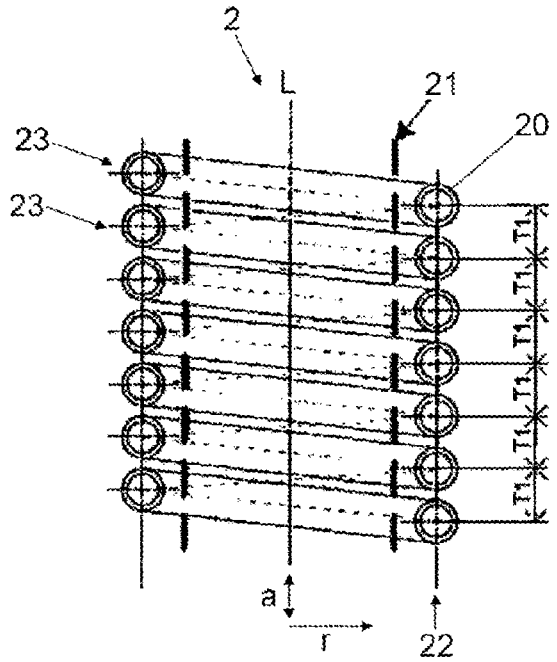
Figure 3:
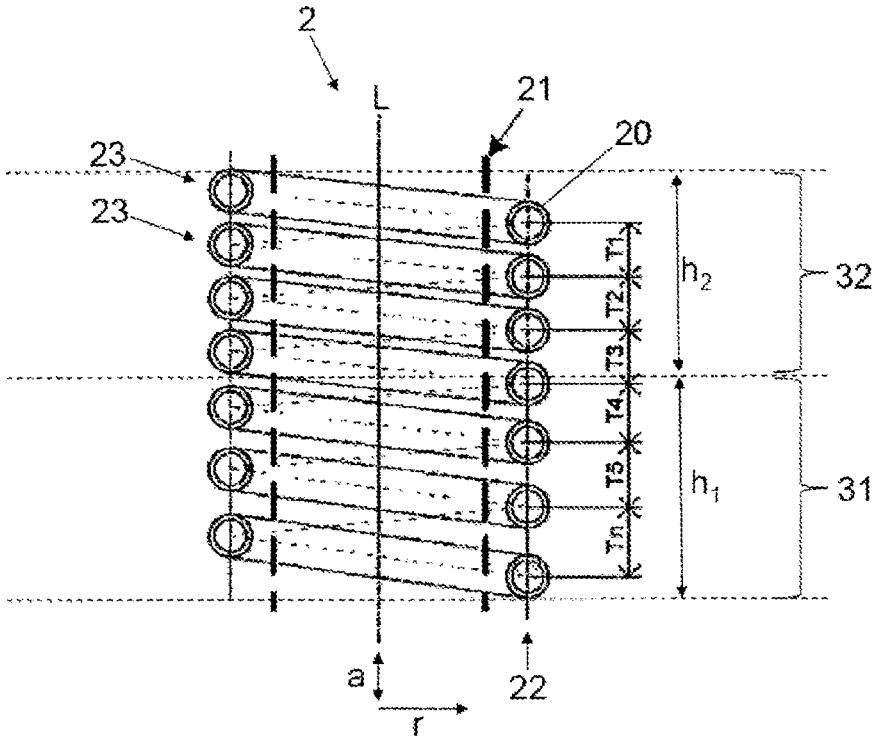
Figure 4:
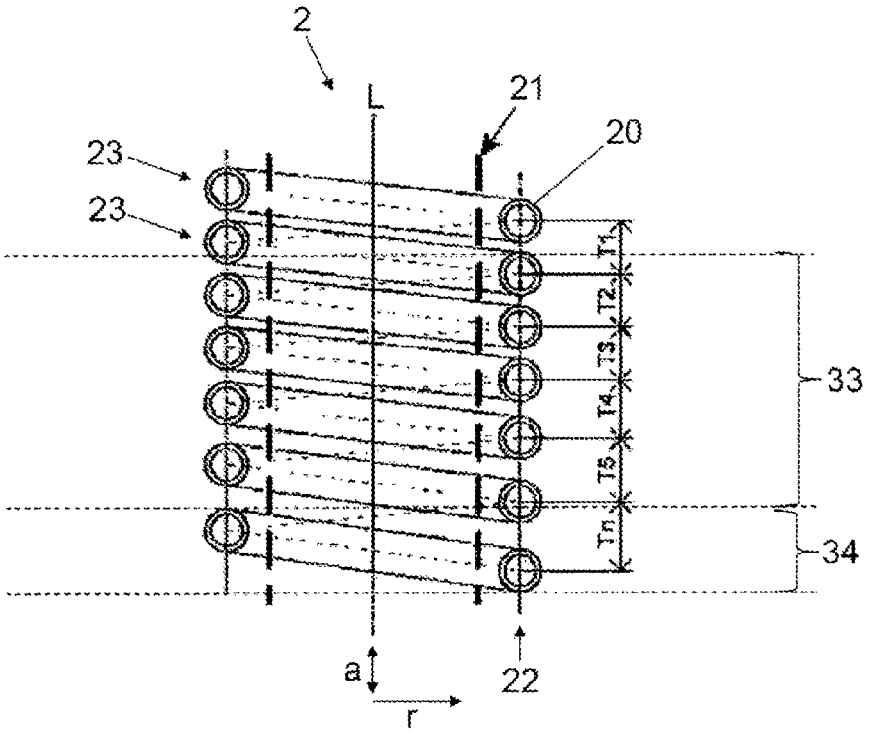
Figure 5:
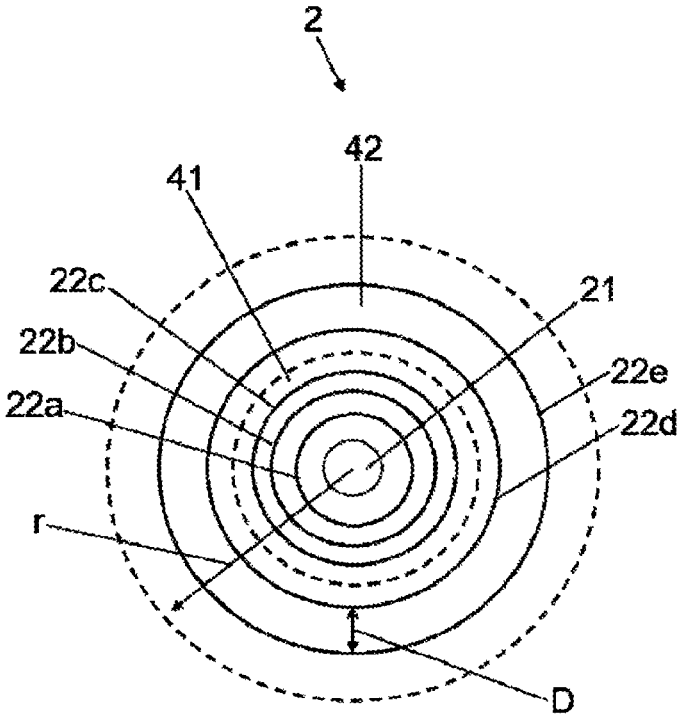
Figure 6:
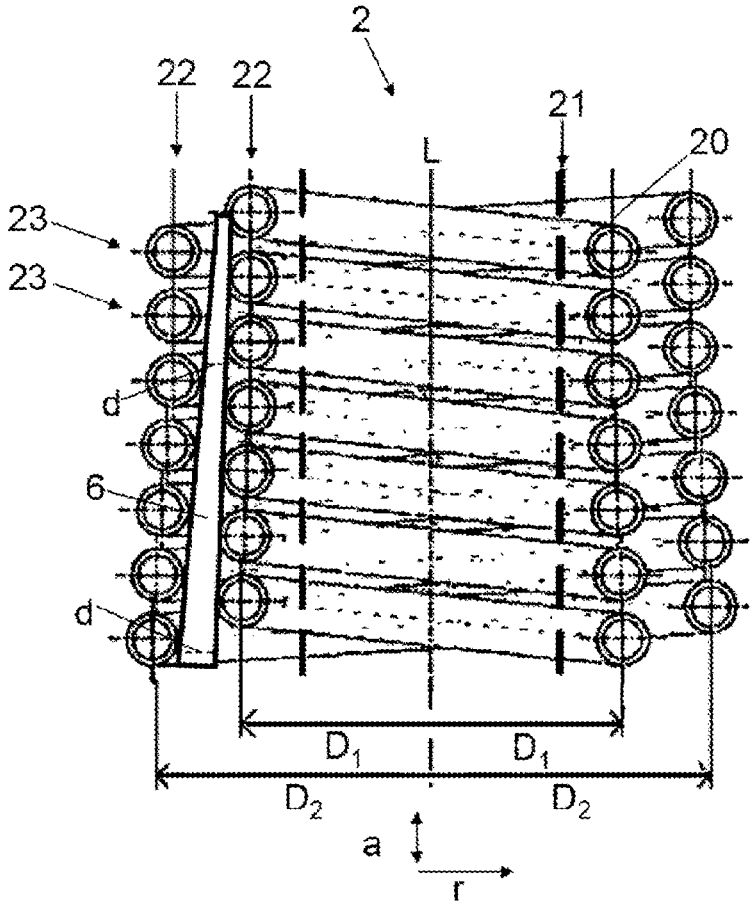

The Following are Shown:

FIG. 1 a partially sectional view of a wound heat exchanger;

FIG. 2 a schematic illustration of a part of a tube bundle of a wound heat exchanger according to the prior art;

FIG. 3 a schematic illustration of a part of a tube bundle of a wound heat exchanger according to this invention with different axial distances between adjacent windings;

FIG. 4 a schematic illustration of a part of a tube bundle of a wound heat exchanger according to this invention with different axial distances between adjacent windings between the central section and end section;

FIG. 5 a schematic illustration of a part of a tube bundle of a wound heat exchanger according to this invention with different radial distances between adjacent tube layers of an inner and an outer region;

FIG. 6 a schematic illustration of a part of a tube bundle of a wound heat exchanger according to this invention with different radial distances of the tube layers from the longitudinal axis.

FIG. 1 shows a wound heat exchanger 1 that has a tube bundle 2 with a plurality of tubes 20, wherein the tubes 20 run along a longitudinal axis L of the heat exchanger 1 and are helically wound around a core tube 21 or onto the core tube 21 so as to run along an imaginary helical path B indicated in FIG. 1.

In particular, the heat exchanger 1 according to the invention according to FIG. 1 has said core tube 21 onto which the tubes 20 of the tube bundle 2 are wound so that the core tube 21 bears the load of the tubes 20. However, the invention is also in principle applicable to wound heat exchangers 1 without a core tube 21 in which the tubes 20 are wound helically around the longitudinal axis L.

The heat exchanger 1 is designed for indirect heat exchange between a first and a second fluid and has a shell 10 which surrounds a shell space M for receiving the second fluid which can for example be introduced into the shell space M via an inlet connection 101 in the shell 10 and, for example, can be removed from the shell space M again via a corresponding outlet connection 102 in the shell 10. The shell 10 extends along said longitudinal axis L, which preferably runs along the vertical relative to a heat exchanger 1 arranged as intended. Furthermore, the tube bundle 2 with a plurality of tubes 20 for conducting the first fluid is arranged in the shell space M. These tubes 20 are wound helically on the core tube 21 in a plurality of tube layers 22, wherein the core tube 21 likewise also extends along the longitudinal axis L and is arranged concentrically in the shell space M.

A plurality of tubes 20 of the tube bundle 2 can each form a tube group 7 (three such tube groups 7 are shown in FIG. 1), wherein the tubes 20 of a tube group 7 can be combined in an associated tube bottom 104, wherein the first fluid can be introduced into the tubes 20 of the respective tube group 7 via inlet connections 103 in the shell 10 and removed from the tubes 20 of the corresponding tube group 7 via outlet connections 105.

Heat can thus be transferred indirectly between the two fluids. The shell 10 and the core tube 21 can furthermore be cylindrical at least in sections so that the longitudinal axis L forms a cylinder axis of the shell 10 and of the core tube 21 running concentrically therein. Furthermore, a skirt 3 which encloses the tube bundle 2 or the tubes 20 can be arranged in the shell space M so that a gap surrounding the tube bundle 2 or the tubes 20 is formed between the tube bundle 2 and said skirt 3. The skirt 3 serves where appropriate to suppress, as far as possible, a bypass flow past the tube bundle 2 of the second fluid fed to the tubes 20 and conducted in the shell space M. The second fluid is therefore conducted in the shell space M preferably in the region of the shell space M surrounded by the skirt 3. Furthermore, the individual tube layers 22 can be supported on one another or on the core tube 21 (in particular when the tube bundle 2 is mounted horizontally) via webs 6 (also referred to as spacer elements) extending along the longitudinal axis L.

FIG. 2 shows a schematic illustration of a part of a tube bundle 2 of the prior art wound around a core tube 21 in a longitudinal section. A tube layer 22 having a plurality of windings 23 is schematically illustrated. The adjacent windings 23 of the tube layer 22 all have the same axial distance T in the axial direction a. Likewise, the adjacent tube layers 22 in the radial direction r all have the same radial distance D from the longitudinal axis L.

FIG. 3 shows a schematic illustration of a part of a tube bundle 2 wound around a core tube 21 according to a first embodiment of the present invention in a longitudinal section. A tube layer 22 having a plurality of windings 23 is schematically illustrated. The adjacent windings 23 have different axial distances T from one another in the axial direction a.

Furthermore, a first section 31 and a second section 32 of the tube bundle 2 adjacent to the first section in the axial direction a are shown. The adjacent tube layers 23 of the first section 31 have greater axial distances T from one another than the adjacent tube layers 23 of the second section 32. In particular, the distances T in the axial direction a can grow monotonically from top to bottom in the vertical, for example in a section 32, 31 of the tube bundle 2 (see FIG. 3). This monotonic growth in sections can also take place from bottom to top in the vertical or along the axial direction a.

In FIG. 3, a first height $h_1$ of the first section 31 and a second height $h_2$ of the second section 32 are also shown. The packing density $p_1$ of the first section 31 and the packing density $p_2$ of the second section 32 can be calculated based on the first height $h_1$ and the second height $h_2$ according to the formulas $p_1=n_1/h_1$ and $p_2=n_2/h_2$, where $n_1$ designates the number of windings 23 of the first section 31, and $n_2$ the number of windings 23 of the second section 32.

In the second section 32, for example turbulence or pressure loss of the first fluid conducted in the shell space M of the heat exchanger 1 can influence the heat exchange between the first and the second fluid. This is optimized here by a more constricted tube layout, that is to say smaller axial distances T.

FIG. 4 shows the embodiment of the tube bundle 2 shown in FIG. 3, wherein a central section 33 and an end section 34 of the tube bundle 2 are identified here. In this case, the axial distances T of the adjacent windings 23 are greater in the end section 34 than in the central section 33. This can enable reduced weight for example in the end section 34, which can have, in particular, structural mechanical advantages when assembling the heat exchanger 1.

FIG. 5 shows a further embodiment of the tube bundle 2 of the heat exchanger 1 according to the invention in a cross-section with respect to the longitudinal axis L (see FIG. 1-4). The core tube 21 and the tube layers 22*a*, 22*b*, 22*c*, 22*d*, 22*e* are shown. Furthermore, an inner region 41 (between the core tube 21 and the inner dashed circular line) and an outer region 42 (between the inner and the outer dashed circular line) are shown. The inner region 41 runs concentrically around the core tube 21 in the shown cross-sectional plane, and the outer region 42 runs concentrically around the inner region 41 in the cross-sectional plane. In particular, the radial distances D of the adjacent tube layers 22*a*, 22*b*, 22*c*, 22*d*, 22*e* can grow monotonically in the radial direction r from inside to outside at least in a section of the tube bundle 2 (relative to the longitudinal axis L).

The adjacent tube layers 22*a*/22*b* and 22*b*/22*c* of the inner region 41 have a smaller radial distance D from one another in the radial direction r than the adjacent tube layers 22*d*/22*e* of the outer region 42.

FIG. 6 shows a schematic illustration of a part of a tube bundle 2 wound around a core tube 21 according to a further embodiment of the present invention in a longitudinal section. Two tube layers 22 of the tube bundle 2 adjacent to one another in the radial direction r and each having a plurality of windings 23 are schematically illustrated. The two shown tube layers 22 have different radial distances D from the longitudinal axis L (i.e., the central axis of the core tube 21) along the axial direction a, so that the tube layers 22 do not run parallel to the longitudinal axis L.

Furthermore, an optional web 6 is shown between the tube layers 22 and has a different thickness d in the radial direction r along the axial direction a (in which its longitudinal direction of extension runs). The web 6 contacts the adjacent tube layers 22 and functions as a spacer between the tube layers 22 in the radial direction r. Such a web 6 can be attached to the tube layers 22 for example by means of tack welding.

The distances between the tube layers 22 formed by the webs 6 allow a better distribution of the second fluid provided in the shell space M between the tube layers 22 so that a more effective heat exchange between the second fluid and the first fluid conducted in the tubes 20 can take place. Naturally, further webs 6 not shown here may be present.

Of course, the embodiments shown in FIG. 3/FIG. 4, FIG. 5 and FIG. 6 can also be combined with one another, i.e., both different axial distances T and different radial distances D can be provided.

LIST OF REFERENCE SIGNS

| | |
|---|---|
| 1 | Wound heat exchanger |
| 2 | Tube bundle |
| 3 | Skirt |
| 6 | Web |
| 7 | Tube group |
| 20 | Tube |
| 21 | Core tube |
| 22, 22a, 22b, 22c, 22d, 22e | Tube layer |
| 23 | Winding |
| 31 | First section |
| 32 | Second section |
| 33 | Central section |
| 34 | End section |
| 41 | Inner region |
| 42 | Outer region |

-continued

| | |
|---|---|
| 101 | Inlet connection |
| 102 | Outlet connection |
| 103 | Inlet connection |
| 104 | Tube bottom |
| 105 | Outlet connection |
| L | Longitudinal axis |
| a | Axial direction |
| r | Radial direction |
| T | Axial distance |
| D | Radial distance |
| d | Thickness |
| M | Shell space |

The invention claimed is:

1. A wound heat exchanger (1) comprising:

a core tube (21) extending along a longitudinal axis (L) in an axial direction (a);

a tube bundle (2) having a plurality of tubes (20) for conducting a first fluid, wherein the tubes (20) are wound about the core tube (21) in a plurality of windings (23), and a plurality of webs (6) extending in the axial direction (a), wherein the webs are provided as spacers between adjacent tube layers (22) in the radial direction such that the webs (6) each form a distance in the radial direction (r) between two respective adjacent tube layers (22), wherein the tubes (20) are arranged in a radial direction (r) perpendicular to the axial direction (a) in a plurality of tube layers (22), wherein the core tube supports the load of the tube bundle, wherein, in at least a section of the tube bundle (2), tube layers (22) adjacent to each other in the radial direction (r) have different radial distances (D) from one another in a cross-sectional plane perpendicular to the longitudinal axis (L), wherein the radial distances (D) of the adjacent tube layers (22) increase monotonically in the radial direction (r), and wherein (a) at least two of said plurality of webs (6) have different thicknesses (d) in the radial direction (r), and/or (b) the thickness (d) of at least one of the webs (6) varies along the axial direction (a) such that adjacent windings (23) of at least one of said plurality of tube layers (22) are spaced different distance in the radial direction (r) from the longitudinal axis.

2. The wound heat exchanger according to claim 1, wherein one or more windings (23) of at least one of said plurality of tube layers (22) have different radial distances (D) from the longitudinal axis (L) in the radial direction (r) than other windings (23) of said at least one of said plurality of tube layer (22).

3. The wound heat exchanger according to claim 2, wherein, in at least in a section of the tube bundle (2), the radial distances (D) of the windings (23) of said tube layer (22) from the longitudinal axis (L) increase monotonically in the axial direction (a).

4. The wound heat exchanger (1) according to claim 1, wherein the tube bundle (2) has a first section (31) and a second section (32), adjacent to the first section (31) in the axial direction (a), wherein adjacent windings (23) of at least one of said plurality of tube layers (22) in the first section (31) have an axial distance (T) which differs from an axial distance (T) of adjacent windings (23) of at least one of said plurality of tube layers (22) in the second section (32).

5. The wound heat exchanger (1) according to claim 4, wherein said at least one of said plurality of tube layers (22) has in the first section (31) a first number (n1) of windings (23), a first height (h1) extending in the axial direction (a) and a first packing density (p1), wherein the first packing density (p1) is equal to the quotient (n1/h1) of the first number (n1) and the first height (h1), and wherein said at least one of said plurality of tube layers (22) has in the second section (32) a second number (n2) of windings (23), a second height (h2) extending in the axial direction (a) and a second packing density (p2), wherein the second packing density (p2) is equal to the quotient (n2/h2) of the second number (n2) and the second height (h2), and wherein the first packing density (p1) differs from the second packing density (p2).

6. The wound heat exchanger (1) according to claim 4, wherein the first section (31) is formed by a central section (35) of the tube bundle (2), wherein the second section (32) is formed by an end section (36) of the tube bundle (2).

7. The wound heat exchanger (1) according to claim 1, wherein the tube bundle (2) has an inner region (41) and an outer region (42) which surrounds the inner region (41) in a cross-sectional plane perpendicular to the longitudinal axis (L), wherein the tube layers (22) of the inner region (41) adjacent to one another in the radial direction (r) have radial distances (D) from one another in the cross-sectional plane that differ from the radial distances (D) in the cross-sectional plane between the tube layers (22) of the outer region (42) adjacent to one another in the radial direction (r).

8. The wound heat exchanger (1) according to claim 1, wherein at least two of said plurality of webs (6) have different thicknesses (d) in the radial direction (r).

9. The wound heat exchanger (1) according to claim 1, wherein the thickness (d) of at least one of the webs (6) varies along the axial direction (r a) such that adjacent windings (23) of at least one of said plurality of tube layers (22) are spaced at different distances in the radial direction (r) from the longitudinal axis.

10. The wound heat exchanger (1) according to claim 1, wherein (a) at least two of said plurality of webs (6) have different thicknesses (d) in the radial direction (r), and (b) the thickness (d) of at least one of the webs (6) varies along the axial direction (a) such that adjacent windings (23) of at least one of said plurality of tube layers (22) are spaced different distance in the radial direction (r) from the longitudinal axis.

11. A method for producing a wound heat exchanger (1) according to claim 1, comprising winding the tubes (20) around the core tube (21) in such a way that tube layers (22) adjacent to one another in the radial direction (r) have different radial distances (D) from one another in a cross-sectional plane perpendicular to the longitudinal axis (L), and the radial distances (D) of the adjacent tube layers (22) increase monotonically in the radial direction (r), in at least a section of the tube bundle (2), and providing the plurality of webs (6) so that they extend in the axial direction (a), and function as spacers between adjacent tube layers (22) in the radial direction of the webs (6), and the webs each form a distance in the radial direction (r) between two respective adjacent tube layers (22), and wherein (a) at least two of said plurality of webs (6) have different thicknesses (d) in the radial direction (r), and/or (b) the thickness (d) of at least one of the webs (6) varies along the axial direction (r) such that adjacent windings (23) of at least one of said plurality of tube layers (22) are spaced at different distances from the longitudinal axis.

12. A method for exchanging heat between the first fluid and a second fluid by means of a wound heat exchanger (1)

according to claim 1, comprising flowing the first fluid flows through the tubes (20) of the tube bundle (2), and flowing the second fluid is provided in a shell space (M) in which the tube bundle (2) of the heat exchanger (1) is arranged so that heat is exchanged between the first fluid and the second fluid.

13. The method for exchanging heat according to claim 12, wherein in a first section (31) of the tube bundle (2) in which turbulence or a pressure loss of the second fluid provided in the shell space (M) influences the heat exchange between the first fluid and the second fluid, the adjacent windings (23) of at least one tube layer (22) have an axial distance (T) that differs from an axial distance (T) of the adjacent windings (23) of the respective tube layer (22) in a second section (32) of the tube bundle (2) adjacent to the first section (31) in the axial direction (a), wherein in the second section (32), the turbulence or pressure loss of the second fluid causes a reduced influence on the heat exchange between the first fluid and the second fluid, wherein the axial distance (T) of the adjacent windings (23) of said tube layer (22) in the first section (31) of the tube bundle (2) is smaller than the axial distance (T) of the adjacent windings (23) of said tube layer (22) in the second section (32) of the tube bundle (2).

14. The method for exchanging heat according to claim 12, wherein in a first section (31) of the tube bundle (2) in which turbulence or a pressure loss of the second fluid provided in the shell space (M) influences the heat exchange between the first fluid and the second fluid, the windings (23) of at least one tube layer (22) have a radial distance (D) from the longitudinal axis (L) that differs from a radial distance (D) of the windings (23) of the respective tube layer (22) from the longitudinal axis (L) in a second section (32) of the tube bundle (2) adjacent to the first section (31) in the axial direction (a), wherein in the second section (32), the turbulence or pressure loss of the second fluid causes a reduced influence on the heat exchange between the first fluid and the second fluid, wherein the radial distance (D) of the windings (23) of said tube layer (22) from the longitudinal axis (L) in the first section (31) of the tube bundle (2) is smaller than the radial distance (D) of the windings (23) of said tube layer (22) from the longitudinal axis (L) in the second section (32) of the tube bundle (2).

* * * * *